United States Patent [19]

Hawkins et al.

[11] Patent Number: 4,549,659

[45] Date of Patent: Oct. 29, 1985

[54] PARTICLE SORTING APPARATUS UTILIZING CONTROLLABLE CORONA DISCHARGE NEEDLE

[75] Inventors: Albert P. Hawkins; Alan Boyle; Alan M. Stone, all of Melbourne, Australia

[73] Assignee: CRA Exploration Pty. Ltd., Sydney, Australia

[21] Appl. No.: 520,124

[22] Filed: Aug. 3, 1983

[30] Foreign Application Priority Data

Aug. 4, 1982 [AU] Australia ..... PF5199

[51] Int. Cl.[4] ..... B07C 5/10

[52] U.S. Cl. ..... 209/3.2; 209/638; 209/589; 209/129; 209/564; 209/908; 430/937; 250/294

[58] Field of Search ..... 209/576, 589, 8, 127, 209/127 C, 129, 638, 130, 3.1–3.3, 564, 908; 430/937; 250/294

[56] References Cited

U.S. PATENT DOCUMENTS 1,358,375 11/1920 Koch ..... 209/638 X 2,646,880 7/1953 Frankel ..... 209/127 C X

FOREIGN PATENT DOCUMENTS 1135232 12/1968 United Kingdom ..... 209/589

*Primary Examiner*—David A. Scherbel

*Assistant Examiner*—Glenn B. Foster

*Attorney, Agent, or Firm*—Cushman, Darby & Cushman

[57] ABSTRACT

Selection means is provided for particles following a free flight trajectory path, those particles having a preselected characteristic, such as fluorescence under x-ray bombardment, being detected and a signal being transmitted on such detection to electrostatic charging means to locally ionize the atmosphere and thereby charge the detected particle as it passes through the locally ionized atmosphere, the charged particle being deflected from its free flight trajectory path by an electric field. Non-detected and uncharged particles continue in the free flight trajectory path. Particles may be detected in a path having lateral spread by providing detecting means and electrostatic charging means which are together responsive to particles in respective portions of the path.

14 Claims, 5 Drawing Figures

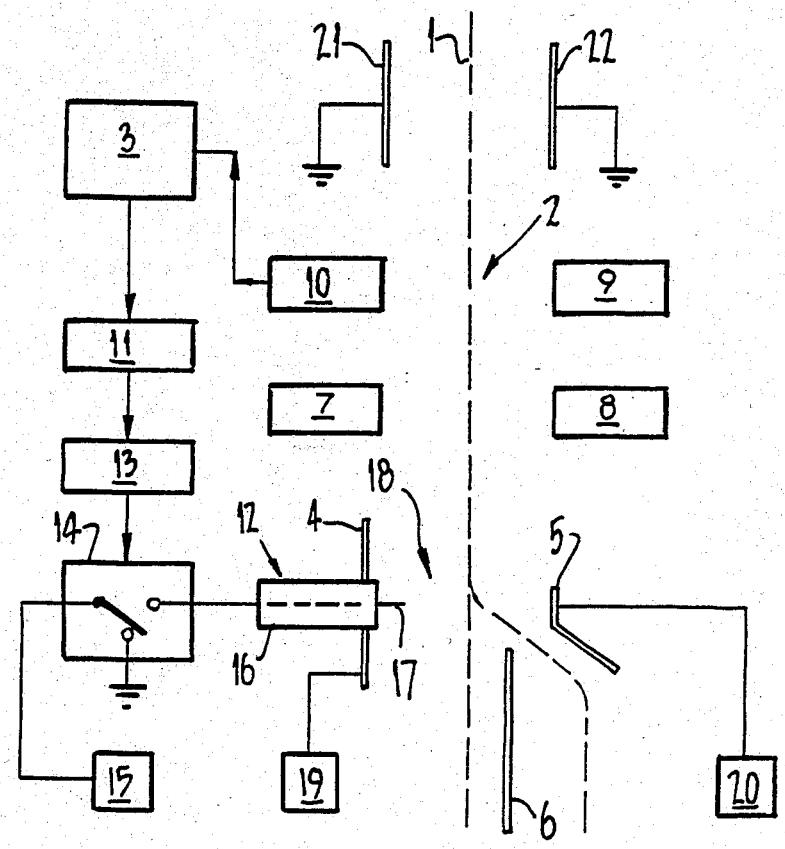
FIG. 1.
FIG. 2.
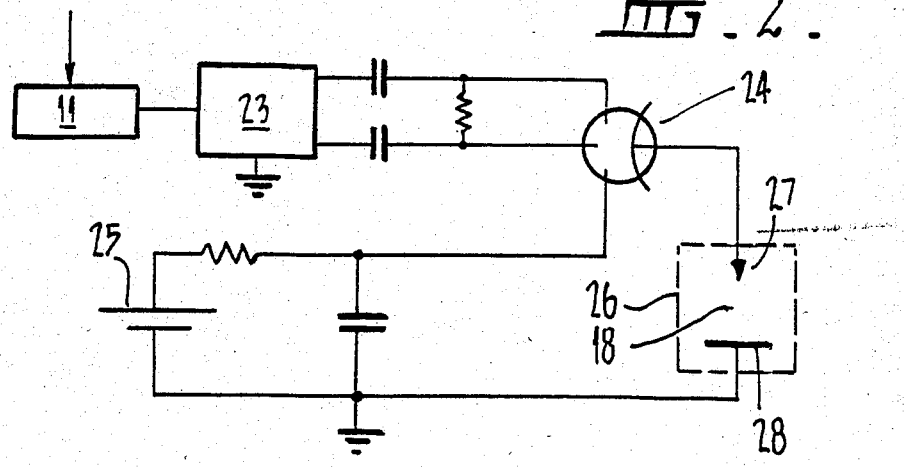

PARTICLE SORTING APPARATUS UTILIZING CONTROLLABLE CORONA DISCHARGE NEEDLE

This invention relates to an apparatus for automatically sorting particulate material according to the degree to which the individual particles possess a certain characteristic. It is particularly, but not exclusively, applicable to automatic sorting of small sized particles on a particle-by-particle basis at high throughputs.

In existing automatic sorting machines, the particles to be sorted are projected in free flight trajectory and selected particles are deflected by blasts of fluid, generally air blasts, by the operation of electrically controlled blast valves. The deflected particles are separated from the undeflected particles by a fixed splitter plate located downstream from the blast zone. The particles are usually projected in a narrow band of adjacent streams each presenting particles one-by-one to a detector and to the fluid blast zone.

These existing machines have severe limitations when it is necessary to treat large numbers of particles on close to a one-by-one basis down to small particle size. In some plants, the material to be sorted is upgraded by feeding low tonnages per unit time to each of several machines, blasting a comparatively large number of undesired particles for each desired particle, and repeating this process by resorting the accepted material a sufficient number of times to produce eventually an acceptable product grade. To increase plant capacity with conventional equipment, several banks of machines treating identical feed in parallel may be required, but if each machine incorporates expensive feed and detection equipment, it is important to minimize the number used to do a given task.

It has also been proposed to separate particulate material electrically. According to this proposal, all particles passing through an electrical charging field are charged according to their electrical surface conductivity. The success of such separation is dependent on sufficient differential electrical surface conductivity of the particular particulate material to be separated. Thus, charge applied to particles passing through the electric field is more mobile on more conductive material and hence able to discharge more fully onto a counter electrode brought into contact with part of the particle surface. However, such differential surface effects are extremely prone to masking by, for example, moisture or other surface contamination, and it is often the case that significant proportions of waste have similar electrical conduction properties to the particulate material to be separated so that separation by this method may not be successful.

The problem of sorting desired from undesired particles whilst diluting the accepted product with as few undesired species as possible and at the same time taking care not to leave any desired particles undeflected, becomes an increasingly difficult task as the size of the particles is decreased and the number of such particles per unit time increases.

It is an object of the present invention to provide a new deflection system which has certain advantages over conventional deflection systems, particularly when sorting smaller sized particles.

According to the present invention, there is provided sorting apparatus in which particles in a free flight trajectory path are deflected according to the degree to which they possess a certain characteristic, wherein the particle deflection means comprises electrostatic means capable of being triggered to selectively charge those particles having the certain characteristic and an electric field generator to establish an electric field effective to deflect the charged particles.

The present invention also provides a sorting method in which particles are projected into free flight trajectory and are selectively deflected by charging selected particles and deflecting them by means of an electric field.

The certain characteristic of the particles to be separated may comprise, for example, one or more of the selective emission or reflection of electromagnetic radiation, the ability to attenuate the passage of electromagnetic radiation, and different electrical conductivity or magnetic susceptibility, and the apparatus in accordance with the present invention will include detection means adapted to determine such characteristic, and control means actuatable on receipt by said detection means of a signal identifying such characteristic to trigger the electrostatic means and charge the particle or particles having the characteristic. Advantageously a source of electromagnetic radiation may be provided to identify the certain characteristic. Thus, in the case where the certain characteristic is a particular electrical conductivity or magnetic susceptibility, a radiation field may be provided which is disturbed in a predetermined manner by the passage therethrough of particles having the characteristic.

In a preferred embodiment of the apparatus for use in detecting diamonds, the particles may pass through an x-ray beam which will produce a fluorescent response in any diamonds present. Such fluorescent response may be detected in the irradiation zone by a photomultiplier-based or microchannel plate intensified detection system.

Advantageously, feed means may be provided to efficiently expose a large number of particles simultaneously to the deflection means, and such feed means may comprise means capable of feeding the particles downwardly in an array curved about a central zone, with the deflection means extending in a corresponding curved array whereby all of the downwardly travelling particles may be subjected to the deflection means. Preferably the curved array is cylindrical. The aforementioned detection means will be located between the feed means and deflector means and will be such as to define a detection zone having a corresponding shape to ensure all particles in the curved array are subjected to the detection means.

The feed means may comprise a radial distributor disposed to receive the particles to be separated from a source such as a hopper and capable of distributing the particles radially outwardly from the central zone to define the curved array. The radial distributor may have a generally conical upwardly facing surface and the particles may be fed from the centre to the edge of that surface at which the curved array is defined, by gravity and/or vibration. Such feed means is described and claimed in our copending application entitled "Particle Distributing and Sorting Method and Apparatus".

The electrostatic means and electric field generator act together to deflect the selected particles having the certain characteristic by local ionization of atmosphere, such as air, and controlled confinement of such ions to charge the particle or particles passing through the confined ionized atmosphere, and deflection of the charged particles in the electric field. The local ionization is obtained, for example, by use of an appropriate corona discharge initiated by a rapidly applied high voltage pulse whenever the electrostatic means is triggered. In one embodiment, a plurality of discharge means, for example 32, may cover respective preselected portions of the trajectory path of the particles, which path may define the aforesaid curved array, and a respective one of said discharge means may be triggered to locally ionize the atmosphere and charge the selected particle. Each discharge means may comprise one or more discharge points.

In order that the invention may be more fully explained, various embodiments of sorting apparatus and method in accordance with the invention will now be described by way of example only, with reference to the accompanying drawings in which:

FIG. 1 is a highly diagrammatic section through one embodiment of the apparatus;

FIG. 2 is a circuit diagram of a modified particle charging assembly for the first embodiment of apparatus;

Figure 3:
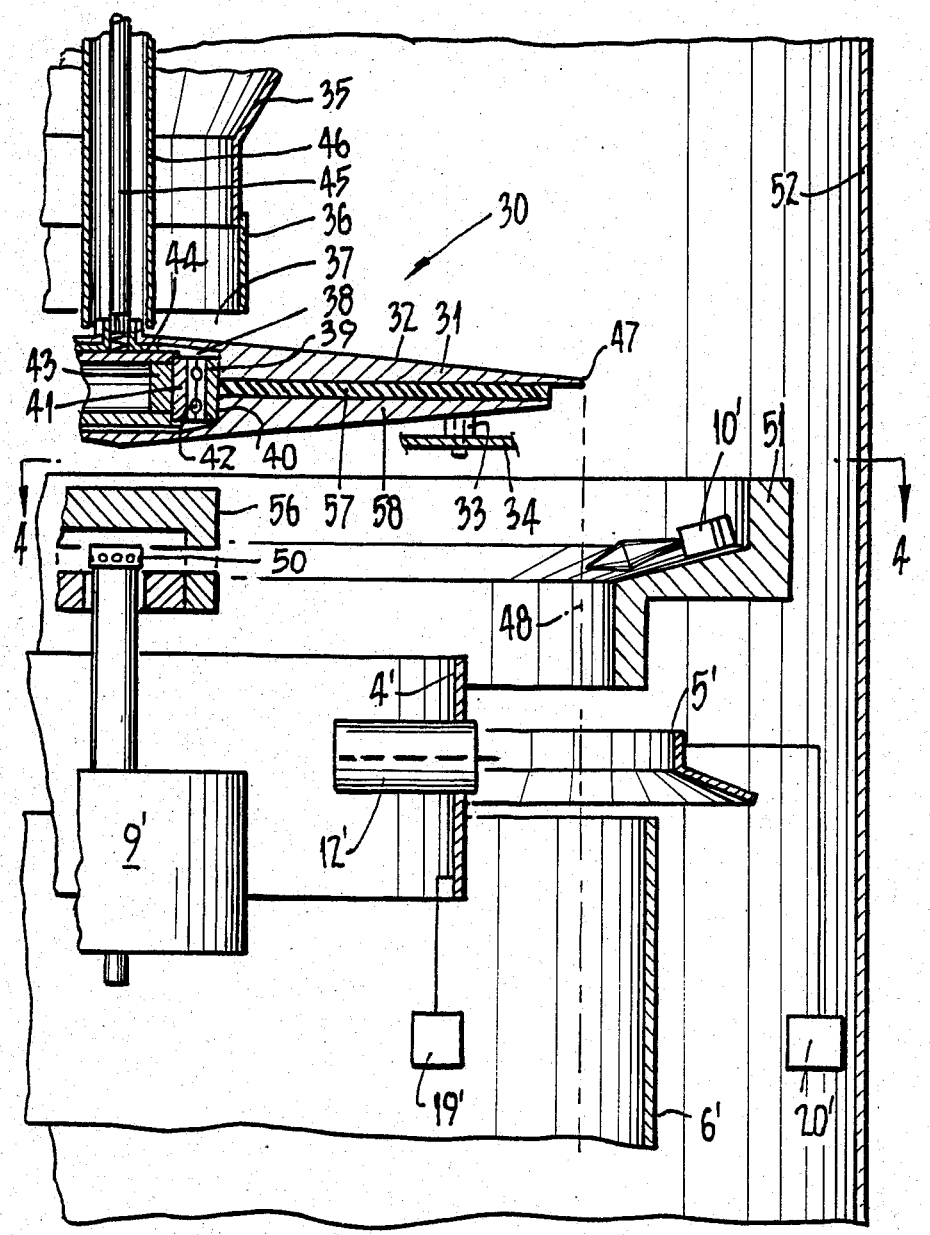
FIG. 3 is a half sectional view of a second embodiment of the apparatus which provides a cylindrical array of particles to be sorted and in which the apparatus shown diagrammatically in FIG. 1 is modified for sorting such cylindrical array.

The illustrated apparatus has been designed for sorting of diamonds from accompanying particulate waste material, and in particular at sizes of around 0.5 to 3 mm square mesh. Accordingly the apparatus will be described with reference to such usage but it will be appreciated that other selected particles may be sorted using suitable detecting means.

With reference to FIG. 1 one embodiment of the method and apparatus in accordance with the invention is illustrated, the apparatus being utilized for sorting a single particle stream 1.

Small stones, which may be for example below 2 mm square mesh, are fed in a single stream 1 from a feed hopper by means such as a vibrating feeder (not shown). It will be appreciated that the apparatus may also be used for stones and particles, or other objects, of size considerably greater than 2–3 mm, although it is believed the main advantages of the apparatus are achieved with the smaller stones and particles. Stones then pass through a detection area 2 where they are classified by any one or combination of established remote sensing systems depending on the detail of properties of interest. In the absence of the desired properties as determined by a discriminator 3, particles would fall through an essentially zero electric field between statically biased parallel plate electrodes 4 and 5 in the stream 1 to a reject side (the left hand side in FIG. 1) of a splitter plate 6.

A minor degree of induction charging may take place on particles due to non-zero electric field in the deflection region between the plate electrodes 4 and 5, but the magnitude of such effect is generally too low to appreciably change the essentially vertically downward path of the stream 1 of particles falling under gravity. Opposed relatively charged electrodes 7 and 8 may optionally be included in the apparatus as a constant ionizing source of negative polarity to precharge particles uniformly and thereby mask any residual surface charge which may be present, due to, for example, triboelectric effects.

After a vertical fall of typically 50 to 300 mm preferably 150 mm, from the feeder, the stones enter the detection area 2 which is defined here, for diamond sorting, by an x-ray beam generated by a suitable x-ray tube 9. The x-ray beam may be confined as desired by a suitable lead collinator (not shown). Fluorescent response of any diamonds in the stream 1 to the x-ray bombardment is detected in area 2 by a photomultiplier 10 of known type, a signal from which, identifying a fluorescent particle in the stream, is transmitted to the discriminator 3.

In the event that the discriminator 3 senses a particle with the desired fluorescent characteristic, a delay circuit 11 is activated by the discriminator, the delay circuit being set so that when the chosen particle has fallen to a position level with a corona discharge means 12, which is located as close below the detection area 2 as practical, a trigger pulse from a generator 13 closes the switching circuit 14 between the discharge means 12 and a positive high voltage source 15. The discharge means 12 comprises a guard electrode 16 and a corona-producing needle 17 which when activated creates an ionizing region 18. If it is desired to have a laterally spread ionizing region 18, a plurality of laterally spaced discharge needles 17 may be provided in each discharge means 12, all of which are activated together. This is particularly advantageous where the detection zone 2 is of greater lateral spread than the ionizing region 18 of any one discharge needle 17. The geometry of the ionizing region and voltages are chosen so that ionization of surrounding molecules of atmosphere, usually air, takes place as the switching circuit 14 is closed. The created ions are rapidly swept to the opposing plate electrode 5 following trajectories always perpendicular to the equipotential electrostatic field lines.

As these gaseous ions intercept the desired particle, as well as any other particles present in the ionizing region 18 at the instant in time that the discharge is applied, the ions tend to attach electrostatically to oppositely charged sites on the surface lattice of such particle or particles. This gives the or each such particle as a whole a large net charge, the magnitude of which is limited after partial saturation by repulsion of further like-charged gas ions moving past the particle surface. The amount of charge which can be imparted to the or each particle is believed to be limited by the breakdown of either the atmosphere or the particle but may be in the order of several thousand volts.

The arrangement described above permits selective charging of particles many times per second and as will be described hereinafter may be made more or less specific; i.e. the ionizing region 18 may be selectively concentrated or expanded.

This arrangement overcomes problems in conventional electrical mineral separation that the charge is dependent on surface conductivity since the particle charging resulting from gaseous ion bombardment provides a rapid and highly spatially localized method of causing particle deflection and subsequent ore/waste separation in an ore sorting context. Its usefulness as a replacement for the usual high pressure air blast valve deflection mechanism in particle sorters lies in its ability to charge very small targets accurately and at operating rates far higher than possible with air blasts so that a higher spatial packing density of the particles to be separated may be used. This is important especially when attempting to sort small particles in the region of 0.5 to 2 mm. Further, such fine particles are easily disrupted by rapid expansion of air caused by blast valves firing at preceding particles. In addition, capital costs of an electrostatic deflector system are potentially lower than air systems, and considerably cheaper to operate. The consumption of compressed air in an air system represents a major cost.

Referring again to FIG. 1 it has been found that diamond bearing kimberlite material of +0.8–2 mm square mesh size can be upgraded by an x-ray based detection system with such a layout, where the discharge needle 17 protrudes 25 mm from the brass permanent field electrode 4 which is held at a steady +10KV potential by a high voltage supply 19. The needle tip is located 35 mm from brass counter electrode 5 which is held at a steady −10 KV potential by high voltage supply 20. Any selectively charged particle is deflected toward the opposite polarity electrode 5 as it falls and is thereby deflected to the right hand side (in FIG. 1) of the splitter plate 6. The counter electrode 5 is angled over its lower portion at 45 degrees to the vertical to alleviate the likelihood of strongly deflected particles bouncing off the electrode and possibly crossing the splitter plate 6 into the reject zone. It has been found that the electrical state of the splitter plate 6, which is located typically 80 mm vertically below the discharge needle level, is not critical, and it can conveniently be made of plastics or metal, depending on wearing qualities desired. It is conceivable that the counter electrode 5 may be earthed in which case the potential of electrode 4 may be increased to say +20 KV.

It may be found that the precharging electrodes 7 and 8 are not necessary but it may be desirable to shield particles in the discharge zone of the feeder (which is typically at least 100 mm above the discharge needle) to avoid uncontrollable flight behaviour of particles which are attracted rather than deflected from the discharge needle 17. This may be successfully accomplished by placement of electrostatic shields to surround the feeder discharge. These electrostatic shields conveniently take the form of earthed brass plates 21 and 22 which screen the particles as they leave the feed-discharge zone. The plates 21 and 22 are shown schematically in FIG. 1 but if used they should closely follow the trajectory path of the particles as they are discharged from the feeder with the plates extending from immediately adjacent the feeder outlet.

In order to confine the corona spatial region 18 of influence to a small size near that of an individual particle requiring deflection, it is convenient to prevent the discharge needle 17 from effectively disturbing an essentially parallel plate electric field arrangement by controlling the geometry of the discharge area. With the system as described above the instantaneous area of influence of the corona beam as it intersects the particle flow may be about 1 cm diameter. The edges of this area are quite sharp. It can be reduced or expanded by changing the amount that the discharge needle 17 protrudes into the region 18 between plate electrodes 4 and 5, that is how much it protrudes from the guard electrode 16 surrounding the needle. As previously indicated it may be desirable to laterally extend the ionizing region 18 associated with each discharge means 12, and this is conveniently done by providing two or more spaced discharge needles 17 in each guard electrode 16. Although the provision of two or more adjacent discharge needles 17 which are arranged to produce corona discharges simultaneously may cause the charging of non-selected particles at the same time as a selected particle is charged. This is considered to be preferable to not charging a selected particle because the particle is not directly in the path of the ionizing region 18 of a discharge means 12 having only one needle 17.

With reference to FIG. 2 the implementation of fast pulsing of the ionization process can be achieved by replacing generator 13, switching circuit 14, guard electrode 16 and needle 17 of FIG. 1 by the elements 23 to 26. In this modified arrangement, delay circuit 11 can provide a rapid pulse to a trigger module 23 such as a TM-11A which is capable of providing a high voltage trigger pulse of very fast risetime, for example 20 KV pulses of width around 10 microseconds with repetition rates of around 50 per second. The trigger output can be used to trigger a 3 element Triggered spark gap 24, typically an EGG - TSG device, which can rapidly switch DC high voltage source 25 of 10 KV to the load 26 of the device which comprises at least one discharge needle 27. By use of such techniques, very rapid and selective breakdown of air can be effected causing very little spread of charge to unwanted adjacent particles in the stream 1. The load 26 defines one or more discharge needles 27 and a plate electrode 28 of −10 KV potential between which is the discharge region 18, the needle 27 and electrode 28 accordingly being equivalent to the needle 17 and electrode 5 in the apparatus of FIG. 1.

Figure 4:
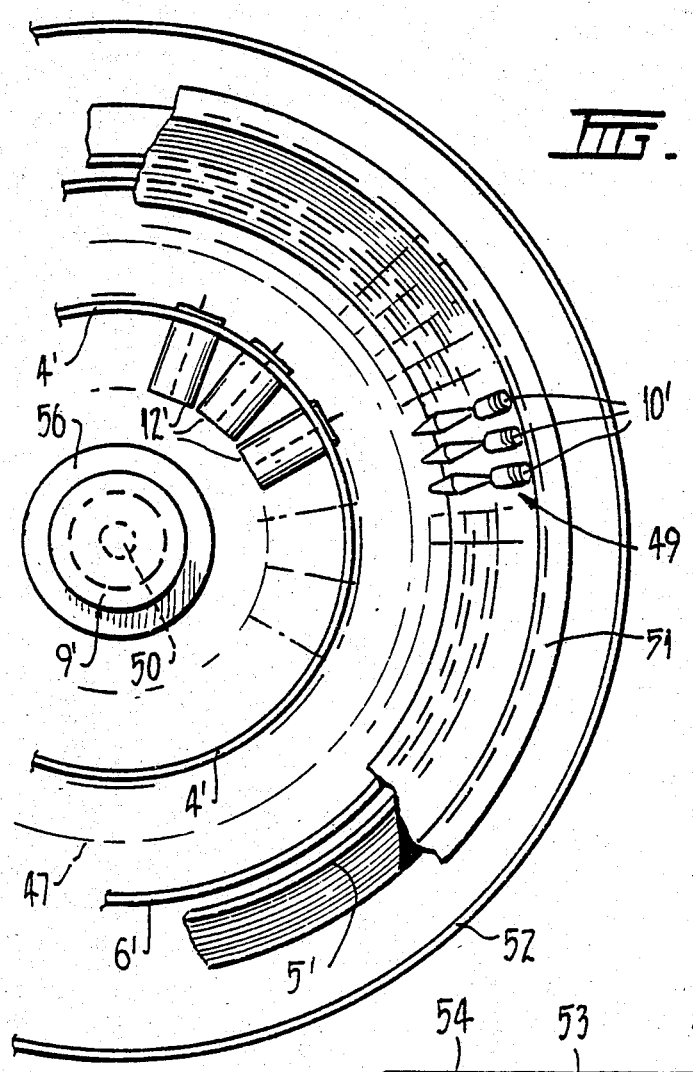
FIG. 4 is a partial plan view of the second embodiment of apparatus taken on the line 4—4 in FIG. 3.
Figure 5:
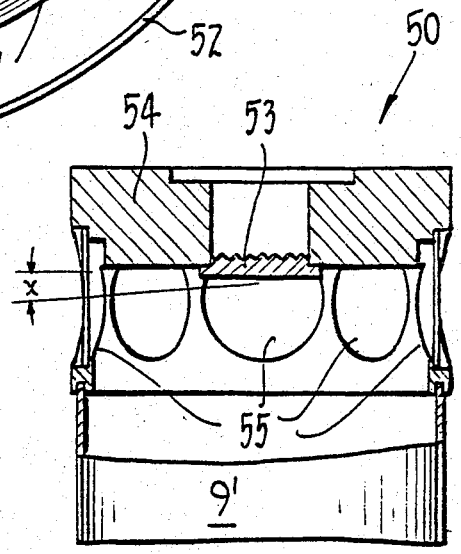
FIG. 5 is an enlarged view, partly in crosssection, of part of the detection apparatus in FIG. 3.

Referring now to FIGS. 3 to 5, there is shown the apparatus generally described with reference to FIG. 1 utilized with a radial particle distributor of the type described in our aforementioned copending application. The radial distributor 30 comprises a circular distributor plate 31 having an upper surface 32 which is shown upwardly conical but which may be flat. An annular core 57 of resilient material is sandwiched between the distributor plate 31 and a downwardly conical balance plate 58 to provide an integral construction which is mounted by way of four, or preferably three, vibration isolating resilient mountings 33 (one shown) on a rigid frame 34. The mountings 33 may extend from the upper surface 32 of plate 31 in order to suspend the radial distributor 30 rather than support it as shown. It is believed that the provision of mountings projecting from the upper surface 32 will not substantially affect the flow of particles from the radial distributor. Preferably the mountings 33 are adjustable to ensure that the distributor 30 extends in a horizontal plane. Particles, including waste particles and the particles to be selected are fed to the upper surface 32 of the radial distributor 30 from a hopper 35. An outlet 37 from the hopper 35 is defined by an annular slide plate 36 which may be moved up and down relative to the hopper and to the upper surface 32 in order to vary the height of the outlet 37. The slide plate 36 may be automatically adjusted through a pneumatic actuator (not shown) to choke the flow of particles so that the feed hopper 35 can be operated at a uniform flow rate for minimization of dilution over a required unit period of operation. The outlet 37 will typically have a gap variable between 5 and 25 mm, the preferred size of which will primarily depend upon the particle size.

The radial distributor 30 has an essentially cylindrical hollow centre portion 38, which as shown is closed at both axial ends. A ball bearing outer race 39 is securely mounted on the cylindrical wall 40 of the hollow centre portion 38 and carries for rotation relative thereto a bearing inner race 41 supported by balls 42. The inner race 41 carries on its radially inner surface an eccentric weight 43 and fixedly supports on its upper surface a keyed sleeve 44 with which is engaged a vertical drive shaft 45 connected to a variable speed motor (not shown). The drive shaft 45 extends vertically through the hopper 35 and is protected from the particles in the hopper by an annular sleeve 46. On rotation of the eccentric weight 43 by the motor and drive shaft 45, the rotationally fixed radial distributor 30 is vibrated in the plane of rotation of the weight which, as shown, is horizontal. The resilient mountings 33 support the distributor 30 while isolating such horizontal vibration from the frame 34. The vibration may be varied by adjusting the radial location of the eccentric weight 43 and/or the speed of rotation.

The radial distributor 30 may alternatively be supported by springs and be vibrated, for example, in a three component multi-plane mechanical motion through rotation of axially spaced eccentric weights, but horizontal vibration is preferred.

From a deep layer at and around the centre of the upper surface 32 of the distributor plate 31, the particles fed from the hopper 35 are induced to work their way to the rim 47 of the upper surface 32 (which typically might have a circumference of 0.5 to 2 m) as they are forced radially outwards by the vibrator action. The shallow cone angle of 0° to 15°, preferably 5°, to the horizontal provides for good particle control during vibration. The particles form an essentially randomly streamed monolayer at the rim 47 prior to being edged over the rim to fall in the annular path 48, accelerating from substantially zero vertical velocity freely under gravity. In accelerating, the annular array of particles tend to separate vertically from each other, allowing clearer detection and deflection. As indicated with reference to FIG. 1, the particles falling from the distributor 30 may be protected by earthed plates 21 and 22 which in the present embodiment would be annular and carried downwardly to follow closely the trajectory of the particles as they leave the distributor 30. Such plates 21 and 22 would extend from immediately above and below, respectively, the rim 47.

The particles to be separated are detected and deflected as they fall using the apparatus described with reference to FIG. 1, except that the stream 48 of particles is annular rather than a single stream. Thus, after falling typically 150 mm, the particles in the annular stream 48 pass an x-ray beam generated by an essentially panoramic x-ray tube 9'. Fluorescence from diamonds in the stream 48 irradiated by the panoramic x-ray beam is picked up by the adjacent one of an annular array 49 of photomultiplier tubes 10' which extends around the x-ray tube 9' at a level with the x-ray emitting end 50 of the tube. The annular array 49 may comprise for example thirty-two photomultiplier tubes 10' (only three are shown in FIG. 4) so that each photomultiplier tube is intended to detect fluorescence in diamonds in a 1/32 arc of the stream 48 of falling particles, the array 49 of photomultiplier tubes being located radially outwardly of said stream and the x-ray tube 9' being located on the axis of the annular stream 48. The array 49 of photomultiplier tubes 10' has an annular lead shield 51 extending thereabout to limit the passage of the x-ray beam and the whole apparatus is located in a cylindrical housing 52 which may also be lead lined.

The x-ray tube 9' may be a diffraction tube modified at its emitting end 50 substantially as shown in FIG. 5 to simulate a panoramic (360°) tube. Electrons emitted by a suitable cathode (not shown) in the tube 9' bombard a plate-like copper anode 53 (or any other suitable anode) supported on an annular lead end piece 54. The emitting end 50 of the tube is provided with an annular array of eight circular beryllium windows 55 which are level with the copper anode 53. Each beryllium window has a diameter of approximately 20 mm and a thickness of the order of 300 microns. The electrons bombarding the copper anode cause the anode to give off x-rays homogeneously and, although the eight beryllium windows do not permit the passage of the x-rays entirely homogeneously around the full 360°, the x-rays will form a continuous beam at a short radius from the tube, normally at about 150 mm from the tube axis, due to overlap of the beams from neighbouring windows. The beam may be confined to a radial 360° wedge of the desired take off angle x, preferably of the order of 6°, by the use of a lead collimator 56 (see FIG. 3) having an annular window extending therethrough at the level of the end portion 50 and photomultiplier tubes 10'.

Each photomultiplier tube 10' may have individual light gathering optics and detectors to improve signal to noise performance from weak signals due to small sized diamonds passing in front of the photomultiplier. An alternative to the use of an array 49 of segmented photomultiplier tube would be to use a single photomultiplier tube and a centrally mounted high speed rotating prism which sweeps the 360° field at a rate and with an instantaneous field of yiew which would ensure that no particles with fluorescent outputs are missed and pass undetected.

As close to the actual detection zone as practical, the annular array 48 of particles, which is advantageously dried prior to entry into the hopper 35, is selectively charged by use of the corona discharge apparatus described herein with reference to FIG. 1 or, alternatively, by for example the apparatus described with reference to FIG. 2. Typically, there may be thirty-two corona discharge segments 12' (only three are shown) together defining an annulus, each with at least one discharge point corresponding to the position of a respective one of the photomultiplier tubes 10'. Accordingly, one corona discharge segment 12' is actuated, after a suitable delay through a respective delay circuit 11, when the photomultiplier tube 10' in the same radial plane picks up fluorescence from a particle passing through the x-ray beam. When the corresponding corona discharge segment 12' is actuated, the surrounding atmosphere molecules are ionized, as previously described, causing localized charge accumulation on the desired particle as it passes through the ionized atmosphere. An annular electrode plate 4' is held at a steady positive potential by a high voltage supply 19' and repels the ions and the charged desired particle, which are all attracted towards an annular negatively charged electrode plate 5' which is connected to a high voltage supply 20'. The attraction of the charged desired particle to the annular electrode plate 5' causes the charged particle to be deflected radially outwardly as it falls to pass on the radially outer side of an annular splitter plate 6'. Non-deflected uncharged particles pass to the radially inner side of the annular splitter plate 6'. As previously indicated a plurality of discharge points may be provided in each discharge segment 12' to ensure that each discharge segment 12' produces an ionizing region covering its share (in this case 1/32 of the annulus).

The apparatus described with reference to FIG. 3 may be modified as previously described with reference to FIG. 1 or FIG. 2. The apparatus illustrated in FIGS. 3 to 5 provides what is effectively a very wide random stream in such a way that all the particles can readily be presented to the detector and deflection components and can remain within close proximity to a single x-ray source target. The absence of belts and associated equipment enables the provision of a compact easily serviceable unit with easy access to the radially disposed detector and deflection modules. The design enables ease of confinement of radiation, both ambient light from getting inside and x-rays from leaking outside, and the apparatus may be made extremely compact considering its throughput capacity. As described with reference to FIG. 1, some particulate materials could be susceptible to triboelectric effects as they pass from the feed hopper and over the radial distributor described with reference to FIGS. 3 to 5, causing random charges on the particles tending to upset the selective charging by the electrostatic deflection system. In that event, it may be desirable to provide a high field source upstream from the electrostatic deflection system to provide a uniform preliminary charge to all of the particles. Such uniform precharge could be opposite to the selective charge imposed by the electrostatic deflection system so that the unselected particles would be reflected in one direction and the selected particles in the opposite direction to increase their separation.

Although as described with reference to FIGS. 3 to 5 the particles fall in a random stream which is continuous in the circumferential direction, there may be applications, particularly in high grade or final sorting operations, in which it is preferred to divide the stream of particles into separate, circumferentially spaced arcuate streams. This may be achieved by providing suitable guides such as radial corrugations or channels or peripheral guides on the radial distributor or by adopting some other feed mechanism.

What we claim is:

1. Sorting apparatus in which particles in a free flight trajectory path are deflected according to predetermined characteristics, wherein a particle deflection means comprises an electrostatic corona discharge means adapted to locally ionize the atmosphere through which selected particles are passing, the corona discharge means capable of being triggered to selectively charge particles having said predetermined characteristics and an electric field generator to establish an electric field effective to deflect the charge particles, the corona discharge means comprising at least one discharge needle supported in a guard electrode and wherein the amount the discharge needle projects from the guard electrode may be selectively adjusted to vary the size of the region of ionized atmosphere.

2. Sorting apparatus as claimed in claim 1 in which the detection means is capable of generating electromagnetic radiation which identifies the predetermined characteristic.

3. Sorting apparatus as claimed in claim 2 in which the predetermined characteristic is fluorescence resulting from x-radiation.

4. Sorting apparatus as claimed in claim 1 in which the electrostatic means includes a delay circuit whereby the discharge means is triggered a preselected time period after the predetermined characteristic has been detected.

5. Sorting apparatus as claimed in claim 1 in which the discharge means comprises a switching circuit adapted to close the circuit between a discharge point and a high voltage source whenever the predetermined characteristic is detected.

6. Sorting apparatus as claimed in claim 1 in which the discharge means comprises a trigger module capable of providing a high voltage trigger pulse and a triggered spark gap device to be actuated by the pulse which is capable of switching a high voltage supply to a discharge point.

7. Sorting apparatus as claimed in claim 1 wherein the electric field generator comprises a counter electrode provided on the side of the particle path remote from the discharge means to attract the ions and selectively charge particles.

8. Sorting apparatus as claimed in claim 7 in which the counter electrode is inclined over at least part of its height to the vertical downwardly away from the discharge means.

9. Sorting apparatus as claimed in claim 7 in which electric field generator comprises a permanent electrode of identical charge to the ionized atmosphere located on the same side of the particle trajectory path as the discharge means.

10. Sorting apparatus as claimed in claim 1 in which opposed electrodes are provided upstream of the electrostatic means on respective sides of the trajectory path as a constant ionizing source to precharge particles uniformly.

11. Sorting apparatus as claimed in claim 1 in which electrostatic shields extend around the trajectory path to screen the particles as they leave a feed zone.

12. Sorting apparatus as claimed in claim 1 which includes a particle feeder capable of feeding the particles in one or more curved arrays and wherein the apparatus is capable of charging and deflecting selected particles throughout said curved array or arrays.

13. Sorting apparatus as claimed in claim 12 in which the electrostatic means comprises a plurality of discharge segments defining an annular array, a respective one of said segments being adapted to be triggered when a particle with the predetermined characteristic is detected in the radial plane of said segment.

14. Sorting apparatus in which particles in a free flight trajectory path are deflected according to predetermined characteristics wherein a particle deflection means comprises an electrostatic means to charge selected particles having said predetermined characteristics passing through said path, and an electric field generator to establish an electric field effective to deflect the charged particles, the apparatus further including a particle feeder capable of feeding the particles in at least one curved array, the electrostatic means comnprising a plurality of corona discharge elements defining an annular array, each of the discharge elements selectively capable of being triggered when a particle with the predetermined characteristics is detected in the radial plane of said element.

* * * * *